United States Patent [19]

Cedar

[11] 4,158,951

[45] Jun. 26, 1979

[54] RING OR BRACELET HAVING PIVOTED LOCKING CLASP

[76] Inventor: Samuel N. Cedar, 14 Worcester Rd., Sharon, Mass. 02067

[21] Appl. No.: 795,815

[22] Filed: May 11, 1977

[51] Int. Cl.[2] ..... A44C 5/00

[52] U.S. Cl. ..... 63/5 R; 24/265 BC; 63/15.65

[58] Field of Search ..... 63/15.45, 15.5, 15.65, 63/5 R, 2, 3; 24/248 R, 248 B, 170, 191, 265 A, 265 BC, 265 WS

[56] References Cited

U.S. PATENT DOCUMENTS

| | | | |
|---|---|---|---|
| 22,358 | 12/1858 | Friend et al. | 63/5 R |
| 322,435 | 7/1885 | Foster | 63/15.65 |
| 744,564 | 11/1903 | Kisling et al. | 63/15.5 |
| 754,714 | 3/1904 | Sedlmair | 24/191 |
| 1,434,981 | 11/1922 | Ballard | 63/15.5 |
| 1,471,675 | 10/1923 | Wilson | 24/191 |
| 1,640,522 | 8/1927 | White et al. | 24/265 A |
| 2,462,425 | 2/1949 | Pratt et al. | 24/248 R X |

FOREIGN PATENT DOCUMENTS

| | | | |
|---|---|---|---|
| 2612030 | 1/1977 | Fed. Rep. of Germany | 24/191 |
| 463179 | 11/1968 | Switzerland | 63/5 R |

*Primary Examiner*—F. Barry Shay

*Attorney, Agent, or Firm*—Wolf, Greenfield & Sacks

[57] ABSTRACT

An adjustable ring or similar article of jewelry having a mesh band which carries a clasp at one end capable of gripping the band adjacent its other end when the band is looped about the finger so as to form a closed ring. The clasp base is crimped to the band end by a bent flange; a clip hinged to the base has side flanges. When the band free-end is threaded through the clasp and the clip is closed, the flanges engage the band and lock it in looped configuration.

2 Claims, 5 Drawing Figures

RING OR BRACELET HAVING PIVOTED LOCKING CLASP

INTRODUCTION

This invention relates to articles of jewelry and more particularly comprises an adjustable ring.

Adjustable rings now available include an interrupted band construction which enables the wearer to alter the effective band diameter by spreading or closing the break in the band. Normally the break in the band is located on the bottom or palm side of the band when the ring is worn so that the break is not visible, particularly because the break detracts from the decorative character of the jewelry. In accordance with the present invention, the very feature of the ring which makes it adjustable provides the principal decorative characteristic of the ring, and consequently, it is not hidden but rather is disposed prominently on the band of the ring on top of the finger.

One important object of the present invention is to provide an adjustable ring or other jewelry article, which provides an infinite adjustment of the ring band diameter.

Another important object of this invention is to provide a ring or other jewelry article having an adjusting clasp which is decorative in character and which therefore sits prominently on the top of the band on the exposed portion of the finger when the ring is worn.

Another important object of this invention is to provide an adjustable ring that may be readily adjusted either before or after the ring is placed on the finger.

Another important object of this invention is to provide a ring which may be wrapped about the finger and then locked in place so that it need not be slipped over the finger joints.

To accomplish these and other objects the ring of the present invention includes a band having a clasp at one end. The clasp when open allows the band to be looped so that the other end overlies the end of the band which carries the clasp. When the clasp is locked, a gripping flange carried by it engages the other end of the band overlying the first end so as to releasably squeeze the band to retain it in the looped configuration.

These and other objects and features of this invention will be better understood and appreciated from the following detailed description of one embodiment thereof, selected for purposes of illustration and shown in the accompanying drawing, in which:

BRIEF FIGURE DESCRIPTION

Figure 2:
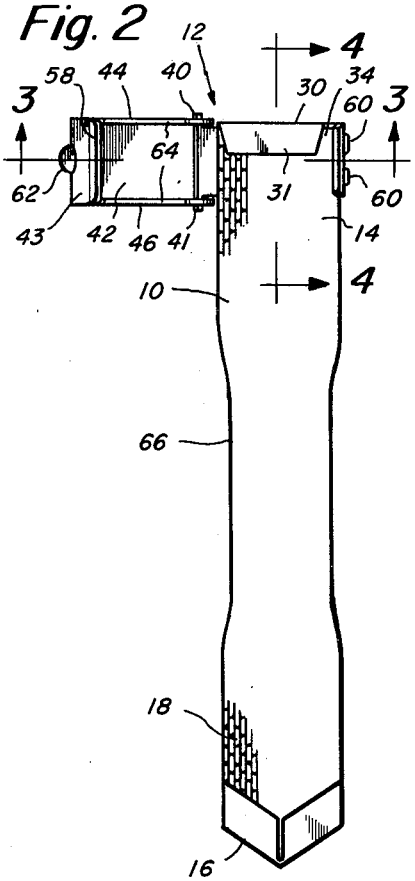
FIG. 2 is a plan view of the ring removed from the finger and with its band in the unlooped position and the clasp open.
Figure 3:
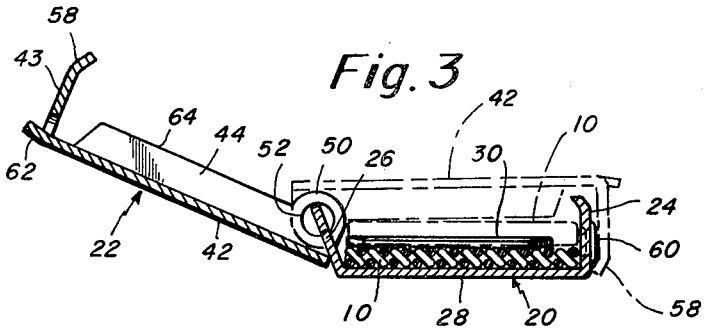
Figure 4:
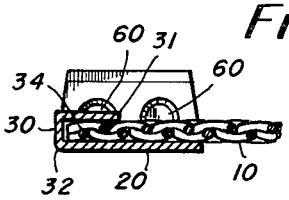

FIGS. 3 and 4 are cross sectional views taken along the section lines 3—3 and 4—4 of FIG. 2, respectively.

Figure 1:
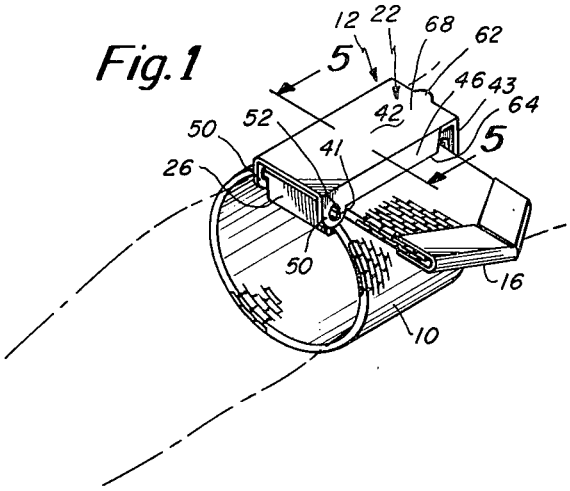
FIG. 1 is a perspective view of the ring of this invention worn on the finger with the decorative clasp exposed on top of the finger and in the closed position.
Figure 5:
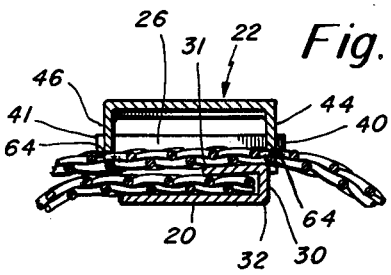

FIG. 5 is a cross sectional view taken along section line 5—5 of FIG. 1.

DETAILED DESCRIPTION

The ring shown in the drawing includes a copper mesh band 10 carrying a clasp 12 on one end 14 and a binder strip 16 at the opposite end 18 of the band. The band 10 may of course be made of brass, stainless steel or any other material, and need not be of the mesh configuration. However, aesthetically the mesh band made of brass is considered most attractive.

Clasp 12 is composed of a base 20 and clip 22. The base 20 is generally U-shaped, having a pair of upstanding arms 24 and 26 connected by bottom wall 28. A flange 30 is formed as an integral part of the base along bottom wall side edge 32. The clasp base 20 is secured to end 14 of the band by flange 30 which is crimped over the edge 34 of the band at end 14 as is evident in FIG. 2. The edge 31 of flange 30 may be bent downwardly to bite into the band material.

Arm 26 carries a pair of integrally formed pins 40 and 41 that extend to the sides of the arm 26 at its top edge, and they serve as hinge supports for the clip 22.

Clip 22 includes a top wall 42 which generally corresponds in shape to the bottom wall 28 of the base, an arm 43 carried on the free end of the clip and generally perpendicular to the top wall 42, and a pair of gripping flanges or bites 44 and 46 that are designed to frictionally engage the upper surface of the band to lock it in a looped configuration as is more fully described below. The ends of flanges 44 and 46 disposed away from the arm 43 are formed with ears 50 having holes 52 that receive the pins 40 and 41.

The free end 58 of arm 43 of clip 22 is toed inwardly somewhat so as to cooperate with the offset dimples 60 formed near the bottom of arm 24 of base 20 so as to releasably lock the clip in the closed position with the gripping flanges 44 and 46 extending downwardly toward the bottom wall 28 of the base. A small offset 62 is also provided on arm 43 to facilitate unlatching the clasp so that clip 22 may be swung to the position shown in FIGS. 2 and 3.

When the clasp is closed, the biting edges 64 of flanges 44 and 46 are spaced from the bottom wall 28 of base 20 a distance which is something less than twice the thickness of the band 10. Consequently, when the band is formed into a loop so that its free end 18 overlies the end 14 of the band which supports the clasp and the clasp is closed, edges 64 grip the surface of the band so that end 18 of the band may not be pulled out of the latch. On the otherhand, when it is desired to open the band, it is only necessary to lift up on the offset 62 to swing the clip away from the base so as to free the end 18 of the band.

As shown in FIG. 2, band 10 is struck along its midportion 66 so as to reduce its width. The reduced width of the band makes it more confortable as it avoids any interference with free movement of the finger on which the ring is worn. Whether or not the width of the band is reduced at the center will of course be dictated by the normal band width.

The upper surface 68 of top wall 42 of the clip may be decorated in a variety of ways. For example, the surface is suitable for the mounting of a stone, or it may be engraved in a decorative fashion. Preferably the clasp is made of a decorative metal material such as brass, and even when the clip is unadorned it is attractive and lends beauty to the ring.

It is obvious from the foregoing that the ring may be adjusted to fit any finger size. And it may be looped and secured in ring form either before or after it is placed on the finger. And it may also be tightened while on the finger to prevent the ring from twisting.

While the jewelry item has been described in the foregoing paragraphs in terms of a ring, it will be apparent that the same features may be used so that the invention may be incorporated into a bracelet. Obviously the length of the band would have to be changed. Otherwise the construction would be just as described.

Those skilled in the art will appreciate that numerous modifications may be made of this invention without departing from its spirit. Therefore, I do not intend to limit the scope of this invention to the single embodiment illustrated and described. Rather, it is intended that the scope of this invention be determined by the apended claims and their equivalents.

What is claimed is:

1. An item of jewelry comprising a band, a clasp secured to one end of the band, said clasp having a generally U-shaped base with a pair of upstanding arms and a bottom wall, said arms extending upwardly on opposite sides of the band at one end of the band and the bottom wall underlying that end of the band, a flange secured to one edge of the bottom wall between the arms and overlying and gripping the end of the band to retain the base on the end of the band, a clip forming part of the clasp and pivotally secured to the top of one of the arms and movable from a first position wherein it closely overlies the base and a second position wherein it is displaced from the base, a pair of parallel bites carried on the clip and lying along opposite side edges of the clip and extending downwardly toward the bottom wall of the base and across the band when the clip is in the first position so that when the band is wrapped in a loop so that it lies between the arms of the base and overlies the top of one end of the band, the bites grip the band to retain it in the looped form, a pair of pins formed as an integral part of said one of the arms and a pair of openings formed as part of the clip, one opening in each bite, and receiving the pins to form the pivotal connection between the clip and base, and latching means formed on the base and clip to releasably retain the clip in the first position.

2. An item of jewelry as defined in claim 1 further characterized by said band having a narrow intermediate section and being made of metal mesh.

* * * * *